United States Patent [19]

Wormser

[11] 4,013,395

[45] Mar. 22, 1977

[54] AERODYNAMIC FUEL COMBUSTOR

[75] Inventor: Alex F. Wormser, Marblehead, Mass.

[73] Assignee: Wingaersheek, Inc., Peabody, Mass.

[22] Filed: Aug. 23, 1973

[21] Appl. No.: 390,792

Related U.S. Application Data

[63] Continuation of Ser. No. 142,402, May 11, 1971, abandoned, which is a continuation of Ser. No. 728,933, May 14, 1968, abandoned, which is a continuation-in-part of Ser. No. 535,215, March 17, 1966, abandoned.

[52] U.S. Cl. ..... 431/9; 431/173; 431/185; 431/353; 239/399

[51] Int. Cl.[2] ..... F23D 13/30

[58] Field of Search ..... 431/9, 158, 173, 185, 431/348, 350, 353, 354; 239/399, 402, 403, 404; 126/91 A

[56] References Cited

UNITED STATES PATENTS

| | | | |
|---|---|---|---|
| 449,315 | 3/1891 | Elwood | 239/399 |
| 664,595 | 12/1900 | Trendel | 431/354 |
| 735,287 | 8/1903 | Neuendorff | 239/399 |
| 1,079,327 | 11/1913 | Chadborn | 239/399 |
| 1,227,829 | 5/1917 | Reichhelm | 431/9 |
| 1,231,726 | 7/1917 | Gault | 431/353 |
| 1,360,981 | 11/1920 | Witt | 239/399 |
| 1,815,322 | 7/1931 | Meader | 431/354 |
| 1,840,453 | 1/1932 | Keith | 239/487 |
| 1,885,067 | 10/1932 | Woodeson | 431/185 |
| 2,070,859 | 2/1937 | Don Howe | 431/348 |
| 2,096,946 | 10/1937 | Van Law | 431/185 |
| 2,115,769 | 5/1938 | Harris | 126/91 A |
| 2,720,257 | 10/1955 | Lynes | 431/354 |
| 2,720,754 | 10/1955 | Francois | 60/39.72 |
| 3,195,609 | 7/1965 | Nesbitt et al. | 431/9 |

FOREIGN PATENTS OR APPLICATIONS

| | | | |
|---|---|---|---|
| 970,222 | 9/1964 | United Kingdom | 431/158 |

*Primary Examiner*—Carroll B. Dority, Jr.

[57] ABSTRACT

This disclosure relates to an aerodynamic fuel combustor for generating hot gases, including means forming a mixing chamber and a combustion chamber, and a flameholder therebetween. Means are provided for admitting desired proportions of fuel gas and air to the mixing chamber to form a combustible gas under a controlled pressure; in one form, these means comprise a jet ejector. The flameholder is a vortex generator having one or more flow channels shaped to supply swirling gases to the combustion chamber. The flow channels form a substantial exit angle with respect to the axis of the combustion chamber, but not exceeding 60°, and are formed by airfoils terminating in bluff trailing edges of substantial area to cause eddying flow. The cooler gas molecules are centrifuged to the outside of the burning gas in the combustion chamber, thus cooling the chamber walls.

27 Claims, 15 Drawing Figures

INVENTOR.
ALEX F. WORMSER
BY
Kenway, Jenney & Hildreth
ATTORNEYS

INVENTOR.
ALEX F. WORMSER
BY
Kenway, Jenney & Hildreth
ATTORNEYS

INVENTOR.
ALEX F. WORMSER
BY
Kenway, Jenney & Hildreth
ATTORNEYS

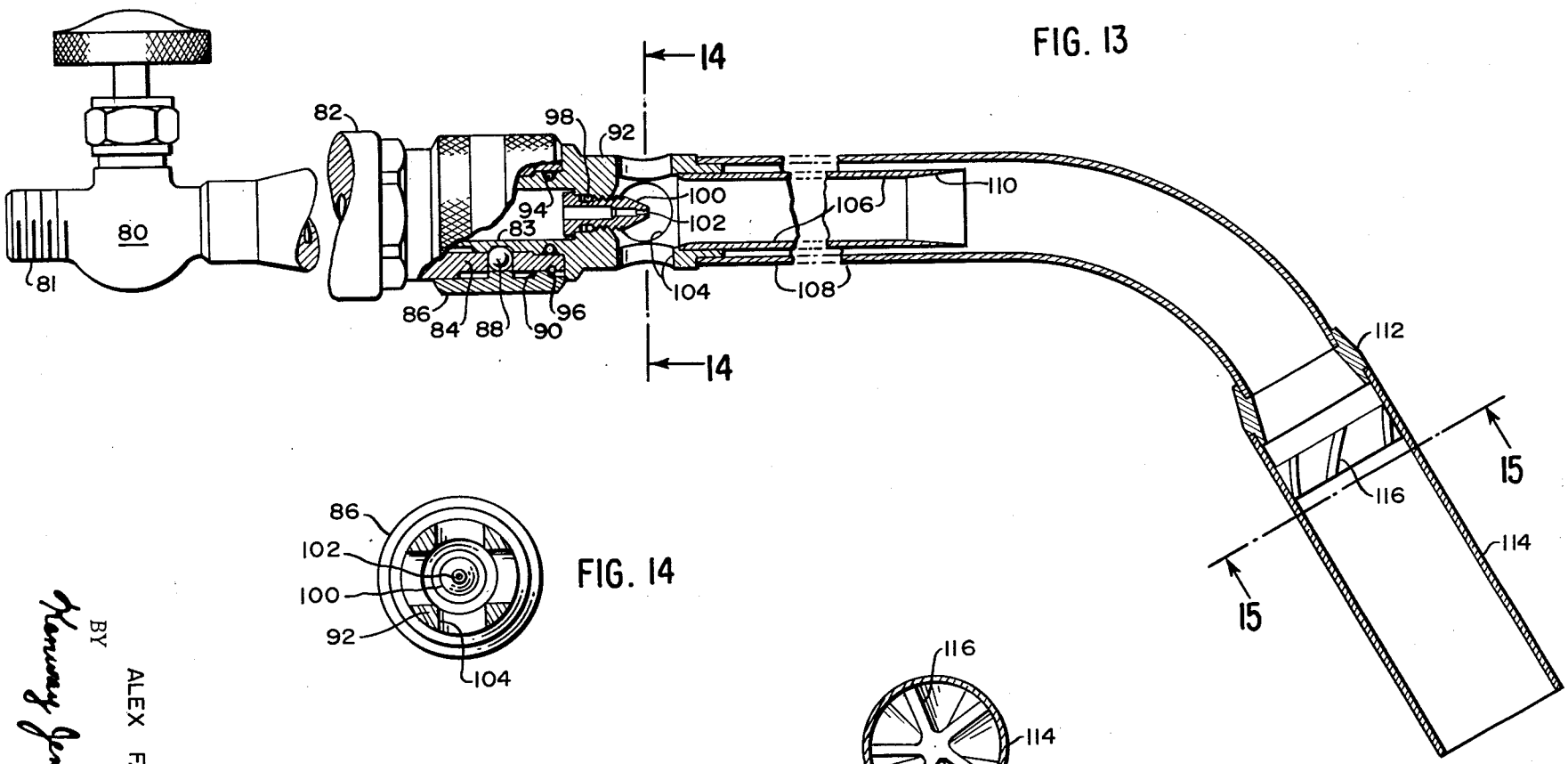
FIG. 13
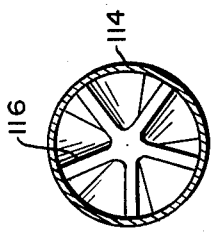
FIG. 15
FIG. 14
INVENTOR.
ALEX F. WORMSER
BY
Kenway Jenney & Hildreth
ATTORNEYS

AERODYNAMIC FUEL COMBUSTOR

This application is a continuation of my co-pending U.S. patent application Ser. No. 142,402, filed May 11, 1971 and now abandoned, which was in turn a continuation of my U.S. patent application Ser. No. 728,933, filed May 14, 1968 and now abandoned, which was in turn a continuation-in-part of my U.S. patent application Ser. No. 535,215, filed Mar. 17, 1966 and now abandoned.

BACKGROUND AND BRIEF DESCRIPTION OF THE INVENTION

Combustion chambers for burning natural gas or premixed fuels with air are used in such divergent applications as central heating, metallurgical processing furnaces and gas turbines. The different requirements for these various applications have resulted in the development of several types of burners for mixing the fuel with air, or another source of oxygen, igniting it, and burning the resulting mixture. Such burners include the familiar Bunsen burner, in which the flame is stabilized by the rim of the burner, the surface combustor, in which an incandescent surface is used to promote and maintain combustion, and aerodynamic combustors such as the toroidal burner and the cyclone burner. In the toroidal burner, a bluff body is introduced into the path of flow of premixed fuel and air, to produce a wake acting to stabilize the flame at relatively high rates of flow by increasing the average residence time of the combustible mixture in the region of the flame. In a cyclone burner, a vortex generator is installed in the flow path upstream of the flame to produce a vortex that also serves to increase the residence time of the gas at the flame.

Bunsen burners are unsuited for high intensity applications because throughflow velocity is very low, generally a few feet per second. Surface combustors are hard to start, since they need to have their walls preheated. They are also limited in life because no known material will last indefinitely if heated to incandescence. Metals tend to oxidize when so heated, and ceramic materials are subject to thermal shock. Accordingly, aerodynamic burners are preferred where high combustion intensity is desired. However, aerodynamic burners of either the toroidal or the cyclone type operate only over a rather narrow range of flow rates (about 4 to 1) and the combustion intensity produced by such burners is limited. Of these, the toroidal burner produces the higher intensity, but with the larger pressure drop. It is also susceptible to damage by flames hitting the walls, and is correspondingly difficult to design.

The primary objects of my invention are to increase the combustion intensity obtainable with aerodynamic gas burners; to increase the range of flow rates and fuel-to-air ratios over which such combustors can be operated; and to provide a selfcooled burner. Additional advantages include ease of starting, simplicity of construction, and the practicability of designing reliable burners in smaller sizes than conventional closed burners.

Briefly, the aerodynamic fuel combustor of my invention comprises a novel flameholder connected between a combustion chamber and a mixing chamber. Means are provided for admitting desired proportions of fuel gas and air to the mixing chamber to form a combustible gas under a controlled pressure. The flameholder comprises a vortex generator including at least one, and preferably two or more flow channels, shaped to supply a vortex of swirling gases from the mixing chamber to the combustion chamber. The flow channels are formed by airfoils terminating in bluff trailing edges of substantial area, causing eddying in the flow.

I have discovered that a surprisingly high combustion intensity can be achieved in a combustor so constructed, with a remarkably small accompanying pressure drop. In addition, a stable flame can be attained over a wide range of fuel-to-air mixtures and flow ranges. A further advantage arises from the fact that cooler portions of the burning gases spend more time in the outer region than in the inner region of the combustion space, helping to keep the walls of the combustion chamber cool.

As applied to gas turbines, the fuel combustor of my invention improves efficiency by greatly reducing the irreversible pressure loss through the fuel burning zone. Such a pressure loss subtracts directly from the available power. For stationary applications, the high combustion intensity attainable makes it possible to use smaller apparatus to effect the same heating purpose and the combustor itself may be made in smaller sizes than is practical with other aerodynamic combustors. The high exit gas velocity obtainable promotes heat transfer in industrial applications such as heat-treatment and melting furnaces. Since fuel and air flow rates may be varied over a wide range, proportional control of temperature, rather than on-off control, is possible. Since burning takes place in a conduit, as it does not in conventional aerodynamic burners, it is possible to ensure that all gases are burned before they mix with surrounding gases, thus improving combustion efficiency. Finally, the combustor of my invention may be designed for a particular application with ease, because burning out of the casing is eliminated as a problem, and because the passages are large and operate at low temperatures, preventing deterioration due to clogging or corrosion.

According to another embodiment of my invention, the improved combustor is combined with a jet ejector or jet pump for the purpose of obtaining the maximum combustion intensity in a burner of relatively small size. This is of particular advantage in selfcontained portable units which use pressurized gas tanks as the fuel source, such as are commonly used by plumbers, roofers and other artisans, as well as by home craftsmen. The jet ejector is joined for serial flow with the combustor in a common torch, which is conveniently mounted on a fuel tank or connected thereto by a flexible tube.

I have found that torches of the type described have a number of advantages over prior torches. These advantages include the fact that torches made according to my invention can burn a stoichiometric mixture of fuel and air without blowing out. Conventional torches use a fuel-air mixture which is rich in fuel; this reduces the velocity of the gas through the torch and thus prevents blowouts. However, to complete combustion, these prior torches used secondary combustion with ambient air at a location downstream of the burner. This secondary combustion is undesirable because it reduces flame temperature as the ambient air cools the flame. The result is that the heating effectiveness of such prior torches is substantially reduced.

Because of the improved burner construction used in torches incorporating my invention, the flame stability is sufficiently high that the torch will burn with a stoichiometric fuel-oxidizer mixture without blowout. Thus torches made according to my invention reach maximum flame temperatures and heating effectiveness. Typically torches of my invention supply hot gases at temperatures about 500° F above conventional torches using the same fuel.

A second problem of all portable torches of the type described is that the torch must use the energy stored as fuel pressure in the fuel tank to propel the combustile gas. In prior torches, much of this stored energy was used for flameholding and relatively little was converted to gas velocity. In torches using the improved combustor of my invention in combination with a jet ejector, a much smaller fraction of the available energy is used for flameholding and a much larger fraction is used to impart velocity to the gas.

As a result of the features of the torch of my invention in use it supplies much higher velocity gases at much higher temperatures than conventional torches, resulting in much higher exit velocities and therefore higher heating effectiveness than prior torches using the same fuel and oxidizer.

The ejector pump used with the torch includes a nozzle for injecting fuel into a diffuser through an entrance chamber having suitable openings for the injection of combustion air. The diffuser delivers the fuel-air mixture into a torch tube having the mixing chamber, flameholder, and combustion chamber at its outlet end. The design of the ejector pump is in itself conventional. In combination with the ejector pump, the improved combustion is observed to produce flame temperature that are 25 per cent higher than prior torches, gas velocities 50 per cent greater than prior torches with resulting heating rates that are 75 per cent higher than presently available conventional torches.

The manner in which the fuel combustor of my invention is constructed, and its mode of operation, as well as the construction and mode of operation of a portable torch using the combustor will be made clear by the following detailed description, with reference to the accompanying drawings, of various embodiments thereof.

In the drawings,

FIG. 13 is a fragmentary view, partially in crossection, of a torch which combines a combustor with a jet ejector pump;

FIG. 14 is a sectional view taken along line 14—14 in FIG. 13, looking in the direction of the arrows; and FIG. 15 is a sectional view taken along line 15—15 in FIG. 13, looking in the direction of the arrows.

Figure 1:
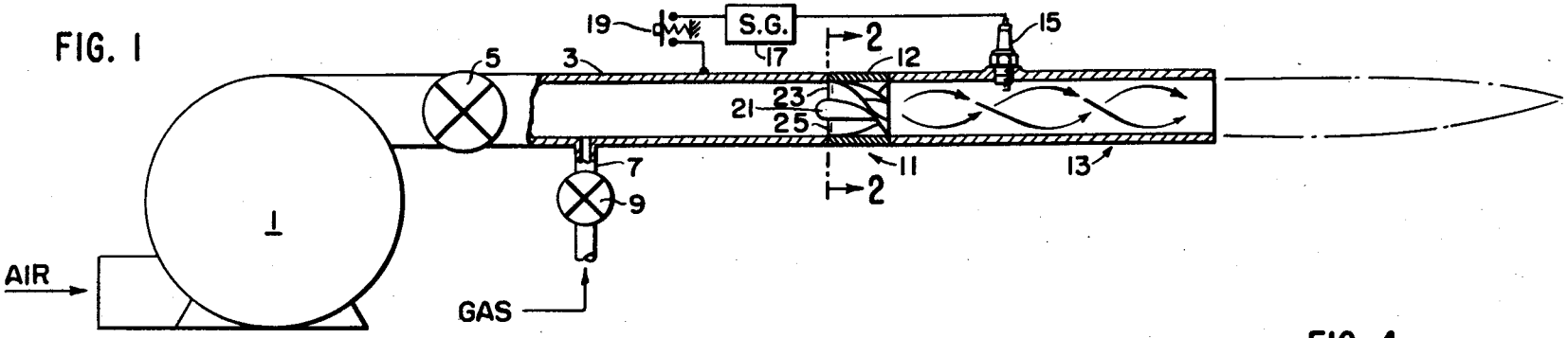
FIG. 1 is a schematic elevation, with parts shown in cross-section and parts broken away, of a fuel combustor in accordance with my invention.
Figure 4:
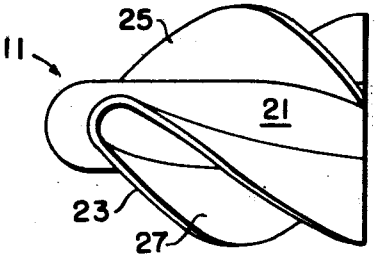
FIG. 4 is a plan view of the inner portion of the flameholder of FIG. 2, taken essentially along the lines 4—4 in FIG. 2.
Figure 3:
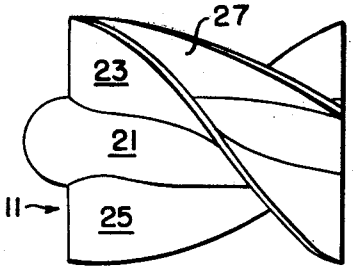
FIG. 3 is an elevational view of the inner portion of the flameholder shown in FIGS. 1 and 2, taken along the lines 3—3 in FIG. 2.

In FIG. 1, I have shown schematically a conventional compressor 1 for supplying air under pressure to a mixing chamber formed by the walls of a conduit 3, of iron pipe or the like. Means are desirably provided for controlling the pressure of the air admitted to the mixing chamber, and for this purpose I have schematically shown a valve 5 connected between the compressor and the conduit 3. Fuel gas is supplied from any suitable source to a line 7 connected to the conduit 3 under the control of a conventional valve 9. A combustible mixture may thus be formed in the conduit 3 having a pressure and composition determined by the settings of the valves 5 and 9.

Downstream of the mixing chamber is located a flameholder generally designated 11 through which the pre-mixed fuel and oxidizing gases are admitted to a combustion chamber defined by the wall of a conduit 13 downstream of the flameholder. As an alternative to the illustrated line 7, a nozzle could introduce fuel at or just downstream of the flameholder for mixing in the conduit 13.

The fuel in the combustion chamber is ignited by any conventional means, here shown as a spark plug 15 that can be supplied with ignition voltage by a spark generator 17. The spark generator 17 may be of any conventional design, such as a spark coil combined with a source of voltage in a known way and adapted to be energized when a pushbutton 19 is momentarily depressed to complete the circuit to the spark generator 17.

FIGS. 2 through 5 show the flameholder 11 in more detail. As shown, it comprises an outer wall 12, that may be formed integral with the conduits 3 and 13 is so desired, and a hub portion 21 on which are formed a pair of upstanding airfoil members 23 and 25 serving to generate a vortex in the pre-mixed fuel and air flowing from the conduit 3.

Figure 5:
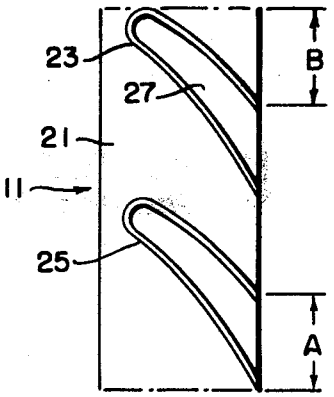
FIG. 5 is a sketch in plan of a development of the surface of the portion of the flameholder shown in FIGS. 3 and 4.

The airfoils 23 and 25 are symmetrically disposed on the hub 21, and are preferably of identical construction. As best shown in FIG. 5, the airfoils 23 and 25 have substantially streamlined leading edges, and terminate in blunt trailing edges.

As indicated in FIG. 5, each airfoil such as 23 is recessed to produce a wall 27 surrounding a region in which no flow takes place. If desired, the airfoils 23 and 25 could be made solid, but the construction shown is lighter.

As indicated in FIG. 5, the dimension A of the trailing edge of each airfoil such as 23 is of the same order of magnitude as the dimension B of each flow channel between the airfoils, so that each airfoil presents a substantial bluff body to the airstream flowing through the flow channels defined by the walls of the conduit 3, the surface of the hub 21, and the outer walls of the airfoils 23 and 25. The dimension A is preferably about the same as the dimension B, such that approximately equal bluff body areas and flow channel areas are present at the trailing edge of the flameholder. Variations in these relative dimensions may be made without drastically affecting performance so long as the bluff body area provided by the trailing edges of the airfoils 23 and 25 is substantial with respect to the area of the exit end of the flow channels between them, but not so large that the bluff body area produces too much pressure drop across the flameholder. For example, if the bluff body area were made either three times the flow channel area, or one-third of the flow channel area, the flameholder would operate in approximately the same manner, but with a much higher pressure drop for the same combustion intensity in the former case, and less stability in the latter. The airfoils should not grow thicker outwardly from the hub, but preferably should have a uniform thickness as shown.

The angle of the swirler, that is, the angle at which the helical flow passages are inclined to the axis of the burner, should be about 45°. More turbulence intensity and pressure drop result if the angle is greater, producing more intense swirling, and the angle should not exceed 60°. Further, the axial velocity should remain high relative to the peripheral velocity, both to obtain a high rate of mass flow and to prevent heating of the combustion chamber walls by the combustion product. The swirling should be sufficient to produce centrifuging of cooler gases to the walls to promote this cooling; but should not divert the axial flow so much as to sweep the walls with a tangential flow of hot combustion products, an antithetical result. The optimum performance is obtained when the pressure drop through the combustor is equally divided between that due to swirling and that due to the bluff body.

As suggested in FIG. 1, the mixed gases emerging from the flameholder 11 form a vortex swirling down the combustion space, and the bluff body action produced by the trailing edge of the airfoils 23 and 25 causes the formation of eddies that create a wake adding to the residence time of the gas molecules in the burning region. In operation, the swirls of the vortex are clearly apparent because they are defined by luminous blue streams of burning gases swirling around in the combustion chamber. Owing to the swirling action, cooler particles in the burning stream tend to accumulate near the wall of the combustion chamber, causing the wall to remain relatively cool until combustion is nearly complete with combustion occurring last at the outer wall 1. Accordingly, in most applications the conduit would be terminated near the point at which combustion is completed.

The size of the apparatus shown in FIGS. 1 through 5 is not particularly critical, and it is possible to go to much smaller diameters than heretofore. The smaller the diameter, the greater the heat intensity. This favors several small burners over one large one if best intensity is desired. Additional airfoils such as 23 and 25 could be added to the flameholder. These would preferably be symmetrically disposed about the hub 11, and should have trailing edges that would be of the same order of magnitude as the flow channel exit areas.

A more symmetrical flame and lower flashback limits are obtained if more airfoils are used, as long as the phenomenon of flame stretch is not encountered. Flame stretch is encountered when:

$$L \leq VT$$

where L is approximately three times the bluff body width in inches, V is the mixture velocity in the passage adjacent the bluff body in inches per second, and T is a characteristic time of $3 \times 10^{-4}$ seconds for stoichiometric mixtures of hydrocarbons in air at atmospheric pressure.

The trailing edge of the hub portion 21 of the flameholder 11 also comprises a bluff body that has some effect on the flow. It is also a suitable location for mounting a fuel nozzle or a swirl plate for use with liquid fuels.

Figure 2:
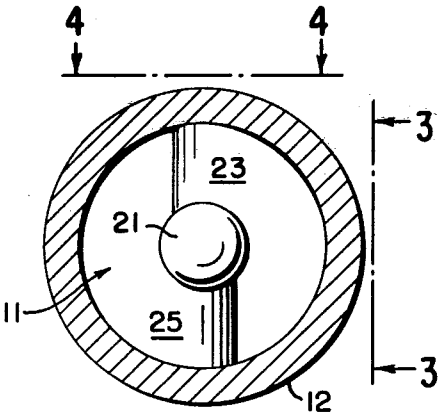
FIG. 2 is an end view of the flameholder forming a part of the apparatus of FIG. 1, taken essentially in the direction of the lines 2—2 in FIG. 1.

As indicated in FIG. 2, the airfoils 23 and 25 each occupy substantially 180° about the axis of the hub 21. Each could cover a larger angle, although no particular advantage has been found in that arrangement. They may occupy less than 180°, the amount of swirl gradually diminishing with smaller angles. For larger numbers of blades, each blade should occupy a circumferential angle of about (360°),/$n$ where $n$ equal the number of blades.

Figure 6:
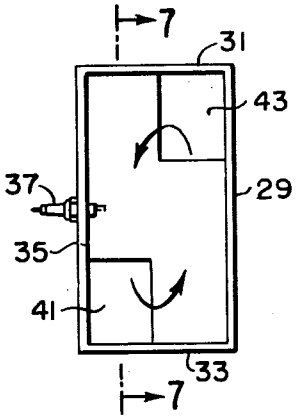
FIG. 6 is an end view of a fuel combustor in accordance with a modified form of my invention.
Figure 7:
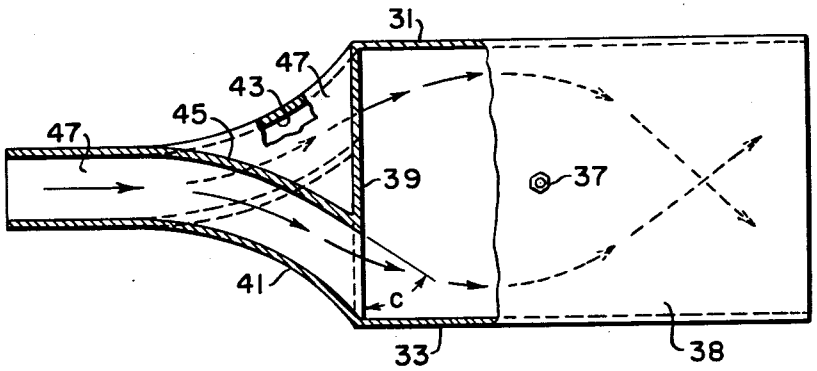
FIG. 7 is a plan view of the combustion of FIG. 6, with parts broken away and parts shown in cross-section essentially along the lines 7—7 in FIG. 6.
Figure 8:
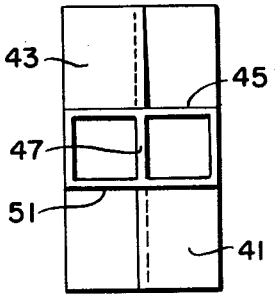
FIG. 8 is an end view of the opposite end of the apparatus of FIGS. 6 and 7.

FIGS. 6, 7 and 8 show a modified combustor in which a rectangular combustion chamber is provided. As shown in FIGS. 6 and 7, the combustion chamber is formed by a bottom wall 29, side walls 31 and 33, and a top wall 35, of sheet metal or the like. An ignition plug 37 is mounted in the top wall 35, as schematically indicated.

The combustion chamber formed by the walls 29, 31, 33 and 35 is open at the lower end in FIG. 7, and closed at the upper end by a wall 39, shown in FIGS. 6 and 7. Within the wall 39 are an upper flow channel exit aperture, through which a portion of an airfoil 41 may be seen in FIG. 6, and a lower flow channel exit aperture, through which can be seen an airfoil 43 in FIG. 6. Referring to FIGS. 6, 7 and 8, the airfoil 41, together with an opposite airfoil 45, a bottom wall 47 and a top wall 49, define a first flow channel. The airfoil 43, together with the bottom wall 47 of the top channel, a second airfoil 51 and a wall 53, form a lower flow channel. The wall 39 serves as a bluff body to induce an eddying wake in the fluid flowing into the combustion chamber, and the upper and lower channels are shaped to provide a swirling action that will create a vortex spiralling down the combustion chamber in the manner suggested in FIG. 7. If desired, the wall 39 may be omitted, as the trailing edges of the airfoils 45 and 51 and the regions behind them would still act as bluff bodies. Preferably, the angle between the exit end of the airfoils such as 45 and the wall 39, as indicated by the angle C in FIG. 7, is 45° or less. Pre mixed fuel gas and air would be supplied to the inlet of the flow channels as indicated by the arrow at the top of FIG. 7, substantially as for the apparatus of FIGS. 1 through 5. The considerations governing the choice of bluff body area provided by the plate 39 and flow channel area are the same as for the apparatus of FIGS. 1 through 5.

Figure 9:
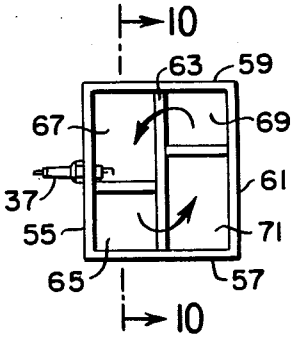
FIG. 9 is an end view of a fuel combustor in accordance with another modification of my invention.
Figure 10:
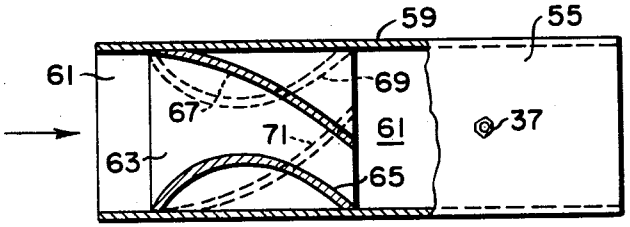
FIG. 10 is a plan view of the apparatus of FIG. 9, taken essentially along the lines 10—10 in FIG. 9 and having parts shown in cross-section.

FIGS. 9 and 10 show a third embodiment of my invention, again incorporating a rectangular conduit but in which the crosssectional area of the inlet end is substantially the same as that of the combustion chamber. In accordance with this embodiment, the inlet channel, the outer walls of the flameholder, and the walls of the combustion chamber are formed by a rectangular channel member comprising an upper wall 55, side walls 59 and 57, and a bottom wall 61, of any suitable material such as sheet metal or the like, connected together in any desired conventional manner, not shown.

In the flameholder, the flow is divided into upper and lower portions by a wall 63. An upper flow channel is defined by this wall 63, the upper wall 55, and two upstanding airfoil boundary walls 65 and 67. A corresponding oppositely oriented lower channel is formed by the wall 63, the wall 61, and two upstanding airfoil walls 61 and 69. The area between the wall 67 and the wall 69 at the trailing edge of the upper channel serves as a bluff body, and the corresponding area between the wall 71 and the wall 57 at the exit end of the lower channel also serves as a bluff body. As before, ignition may be produced by a suitable device such as the spark plug 37 mounted in the combustion chamber substantially as shown.

Figure 11:
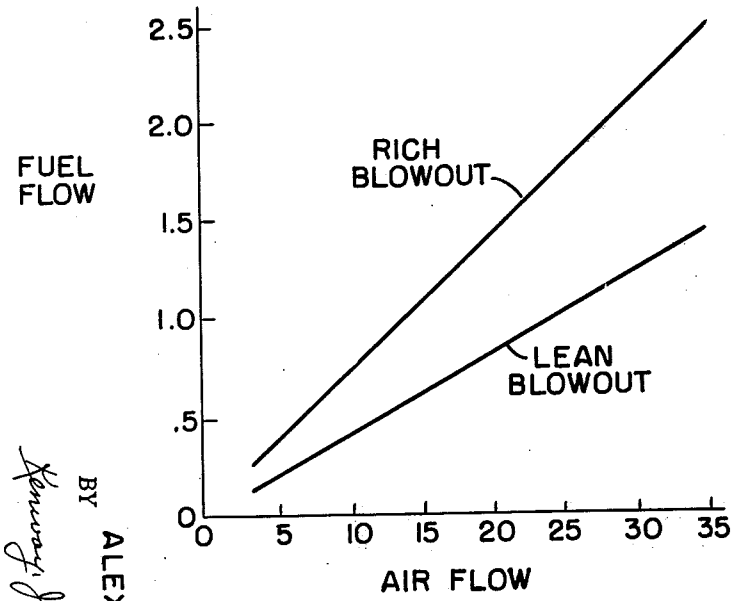
FIG. 11 is a graph illustrating the performance of a fuel combustor of my invention, showing its operating range in terms of the relationship between fuel flow and air flow.

Referring now to FIG. 11, I have shown typical data taken on combustors built in accordance with my invention, and indicating the relationship between rich blow-out and lean blow-out in terms of fuel flow in pounds per hour versus air flow in pounds per hour. At any given air flow within the range, as the fuel flow is varied a point will be reached on the low fuel side at which the flame will go out because the mixture is too lean to burn. Similarly, as the fuel flow is increased, a point will be reached at which the mixture is too rich to burn and the flame will go out. The wide range of allowable mixtures is remarkable and is nearly as wide as that of quiescent mixtures, which represents a theoretical maximum. Also unusual is the wide range of flows between flashback (at low flows) and high speed blow-out. Ordinarily, this is 4:1 or less for the present burner it is 100 to 1.

Figure 12:
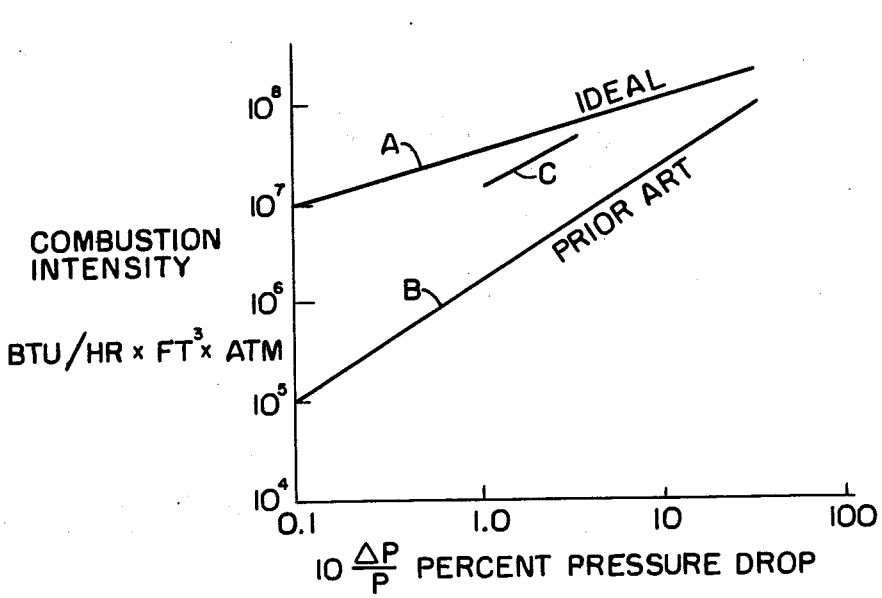
FIG. 12 is a graph illustrating the performance of fuel combustors in accordance with my invention in terms of the relationship between combustion intensity and percentage of inlet pressure drop taking place in the burner.

FIG. 11 shows another measure of the performance of the combustor of my invention. The upper curve A in FIG. 12 is a theoretical upper limit of performance in terms of combustion intensity in BTU's of heat released per hour of operation per cubic foot of combustion space per atmosphere of inlet pressure, versus the percentage pressure drop obtained by multiplying the pressure drop through the combustor by 100 and dividing the result by the absolute pressure at the combustor inlet. Curve B is taken from a standard textbook, by M. W. Thring, on *The Science of Flames and Furnaces*, p, 251, published in 1962 by Wiley & Sons, and indicates the performance of typical combustors of the prior art. Curve C is taken from data based on the operation of combustors made in accordance with my invention, and indicates the dramatic improvement in combustion intensity that is obtained at a very low relative pressure drop. High temperatures, in the neighborhood of 3400° F., can be produced by combustors of my invention with little difficulty or danger.

Referring to FIGS. 13 – 15, a torch is shown which combines an air ejector pump with my improved combustor. This combination is particularly advantageous in that it provides a highly compact unit, suitable for mounting on or being connected to a portable fuel tank, and yet affords an ample supply of air to the combustor to complete the burning of the fuel within the combustion chamber, thereby securing the maximum combustion intensity. Furthermore, the ratio of fuel to air is substantially uniform over a wide range of fuel pressures, which vary a great deal as the supply in a portable tank is consumed.

The torch includes a valve 80 having a threaded nipple 81 for attachment to a pressurized fuel tank (not shown). A handle 82 delivers fuel through an internal passage 83 to an ejector nozzle 100. The nozzle is threaded into a nipple 92, and is provided with an O-ring seal 98 to prevent leakage. The nipple is removably mounted in an end portion 84 of the handle, and is normally locked in place by a ball 88. A collar 86 is slidably received on the end portion 84 and in the position shown holds the ball 88 in locking relation to the nipple 92. The collar is slidable to the left as viewed in FIG. 13, so that the ball may drop into a recess 90, freeing the nipple for removal from the handle 82. A retaining ring 96 limits the movement of the collar to retain it in assembly with the handle. A further O-ring seal 94 prevents leakage of fuel between the nipple 92 and the handle end portion 84.

The nipple 92 forms an entrance chamber for a diffuser tube 106. A series of air inlet ports 104 admits a flow of air from the atmosphere into the diffuser; the air is pumped by a stream of fuel passing through an orifice 102 in the nozzle 100, which is aligned with the axis of the diffuser 106. The fuel and air are carried from a diverent end 110 of the diffuser into a tube 108 connecting the ejector with a combustor at the end of the torch. The tube 108 is cured in a conventional manner which adds to convenience in using the torch.

The combustor includes a divergent mixing chamber 112 at the end of tube 108. The divergence is gradual, to reduce the chance of flashback and to improve pressure recovery. A cylindrical flame tube or combustion chamber 114 is affixed to the mixing chamber, and receives a flameholder 116 which is substantially similar to the flameholder 11 previously described in connection with FIGS. 1–5. However, the airfoils maintain the same cross-sections throughout their lengths; this form is convenient to manufacture, and serves the purpose satisfactorily. The combustor operates in substantially the same fashion as in the embodiments previously described.

The jet ejector pump is designed according to conventional principles, as outlined for example in "The Design of Jet Pumps", A. Edgar Kroll, Chemical Engineering Progress, February, 1957. The ratio of the diameter of the diffuser 106 to that of the fuel orifice 102 may range from less than 20 to more than 30 to 1, depending on the fuel used. In general, it may be said that if the ratio of the diameter of the diffuser to the diameter of the fuel orifice is excessive, the pressure of the mixture reaching the combustor will be inadequate; on the other hand, if the ratio is excessively small, the mixture will be correct for only a very small range of fuel supply pressures. Since the pressure of portable fuel tanks varies a great deal in normal use, it is more practical to use a ratio of these diameters which is on the high side of the range.

The optimum performance is obtained when the ratio of the length of the diffuser tube 106 to its diameter is about 12 to 1, and this ratio should at least equal 5 to 1. A choice of the ratio of diffuser length to diameter which is toward the low end of the range may adversely affect the pressure of the fuel mixture delivered to the combustor; however, too large a ratio results in a cumbersomely long unit.

The improved torch generates a stoichiometric mixture which is completely combusted within the flame tube 114, according to the principles of the invention, without requiring a large and heavy air pump or a separate oxygen tank. A conveniently portable torch is provided which nevertheless achieves the previously-described advantages of the invention.

Within the broader aspects of my invention, the details of construction of the flameholder are significant only insofar as they contribute to the performance of the functional characteristic of the invention. Specifically, a swirling motion must be imparted to the inlet gas, and the outlet port or ports of the flameholder must terminate in bluff bodies of substantial area. The airfoils defining the flow passages through the flameholder may take various forms other than those specifically described above. For example, the flameholder might comprise a set of one or more passages defined by the inner walls of one or more metal tubes wound helically about a common axis in essentially the manner in which the strands of a cable are laid, with the interstices between the walls blocked to provide bluff bodies at the exit ends of the passage. Other modifications will occur to those skilled in the art upon reading my description. Thus, while I have described my invention with respect to the details of various specific embodiments thereof, such changes and adaptions that will occur to those skilled in the art upon reading my description, using the burner in other forms or as an element in more complex systems, can obviously be made without departing from the scope of my invention.

Having thus described my invention, what I claim is:

1. A fuel burner which comprises:

a mixing chamber, said mixing chamber including means for introduction thereinto of combustible material and combustion-supporting gas material and for mixture of the same therein to produce a combustible mixture, and including a downstream mixing chamber outlet, a combustion chamber, said combustion chamber including a combustion chamber inlet and a combustion chamber outlet, and a flameholder, said flameholder being positioned between said mixing chamber outlet and said combustion chamber inlet and including a hub, a plurality of vanes extending outwardly from said hub, and enclosure means for cooperation with said vanes in defining a corresponding plurality of separated passages through said flameholder, said vanes including mixture guidance surfaces at an angle to the direction of net fluid flow through said flameholder from said mixing chamber to said combustion chamber, to produce a whirling motion in said mixture, said vanes including also downstream end bluff body means for producing eddying of said mixture thereat, said eddying being of amount effective, in conjunction with said whirling motion, to hold separate flames at respective separate said vanes, thus producing a visible blue whirling flame pattern, said combustion chamber having an inner surface for confining and guiding burning mixture and efficient delivery, for then doing work, of hot gas through said combustion chamber outlet, and said combustion chamber outlet being open.

2. The burner of claim 1 in which said inner surface is cylindrical adjacent said flameholder.

3. The burner of claim 2 in which said inner surface is cylindrical from said flameholder to said combustion chamber outlet.

4. The burner of claim 3 in which said inner surface has the same diameter as the downstream end inner surface of said enclosure means.

5. The burner of claim 1 in which said combustion chamber is defined by a thin metal wall, and said whirling prevents said wall's becoming hot therethrough adjacent said flameholder.

6. The burner of claim 5 in which said angle is less than 60°.

7. The burner of claim 6 in which said angle is 45°.

8. The burner of claim 2 which is a torch.

9. The burner of claim 8 in which said mixing chamber includes a jet ejector pump with air inlet ports.

10. The burner of claim 9 in which said jet ejector pump includes a diffuser.

11. The burner of claim 1 in which said combustion chamber is of length for accommodation therein of full combustion of said mixture.

12. The burner of claim 9 in which said torch is portable and in which said mixing chamber is adapted for mixing pressurized combustible gas and ambient air.

13. The burner of claim 12 in which said combustion chamber is enclosed by a thin metal wall.

14. The burner of claim 1 in which the ratio of total vane cross-sectional area to total passage cross-sectional area in said flameholder is in the range from 1:3 to 3:1.

15. The burner of claim 14 in which said range is from 1:3 to 1:1.

16. The burner of claim 15 in which said ratio is 1:1.

17. The burner of claim 14 in which the pressure drop owing to said whirling motion is equal to the pressure drop owing to said eddying.

18. The method of heating a workpiece efficiently which comprises mixing a combustible material and a combustion-supporting gas material to produce a combustible mixture, giving the said mixture a rotating movement by advancing it against vanes positioned at an angle to the net direction of movement, producing localized eddying at downstream ends of said vanes by bluff body effects caused by end means of said vanes, burning said mixture in a combustion chamber downstream of said vanes, and discharging said hot mixture from an open end of said combustion chamber against said workpiece, said eddying being sufficient, in conjunction with said rotating movement, to hold a separate flame at each of said vanes, thereby to produce a characteristic blue whirling flame pattern.

19. The method of claim 18 in which said vanes are at an angle of less than 60° to said net direction of movement.

20. The method of claim 18 in which the ratio of total cross-sectional said vane area to total cross-sectional said passage area is 1:3 to 1:1.

21. The method of claim 18 in which combustion of said mixture is completed just as it emerges from said combustion chamber outlet.

22. The burner of claim 2 in which said inner surface is imperforate.

23. The burner of claim 2 in which said vanes are imperforate.

24. The burner of claim 23 in which the inner surface portions of said enclosure means lie in the same imaginary cylindrical area.

25. The burner of claim 2 in which each of said passages is of the same cross-section throughout its length in the direction of flow.

26. The burner of claim 14 in which the outside diameter of said hub is less than half the inside diameter of said enclosure means.

27. The burner of claim 4 in which said inner surface is imperforate and has the same diameter as the downstream end inner surface of said enclosure means, said combustion chamber being defined by a thin metal wall and of length for accommodation therein of full combustion of said mixture, said angle is 45°, said whirling prevents said wall's becoming hot therethrough adjacent said flameholder, the ratio of total vane cross-sectional area to total passage cross-sectional area being in the range from 1:3 to 3:1, each of said passages being of the same cross-section throughout its length in the direction of flow and said vanes being imperforate, the pressure drop owing to said whirling motion being equal to the pressure drop owing to said eddying, the inner surface portions of said enclosure means lying in the same imaginary cylindrical area, and in which said burner is a torch including also a jet ejector pump and a diffuser in said mixing chamber, said mixing chamber being adapted to mix pressurized combustible gas and ambient air, and said torch being portable.

* * * * *